United States Patent [19]

Lerner et al.

[11] Patent Number: 4,969,310

[45] Date of Patent: Nov. 13, 1990

[54] PACKAGING MACHINE & METHOD

[75] Inventors: Hershey Lerner, Aurora; Rick S. Wehrmann, Hudson, both of Ohio

[73] Assignee: Automated Packaging Systems, Inc., Twinsburg, Ohio

[21] Appl. No.: 351,702

[22] Filed: May 12, 1989

[51] Int. Cl.[5] ..... B65B 43/12

[52] U.S. Cl. ..... 53/459; 53/384; 53/468; 53/568

[58] Field of Search ..... 53/459, 568, 567, 492, 53/384, 381 R, 455, 468, 469

[56] References Cited

U.S. PATENT DOCUMENTS

| | | | |
|---|---|---|---|
| 3,359,703 | 12/1967 | Quaadgras | 53/568 X |
| 3,559,874 | 2/1971 | Titchenal | 229/69 |
| 3,583,127 | 6/1971 | Marchand | 53/459 |
| 3,618,286 | 11/1971 | Membrino | 53/384 X |
| 3,699,746 | 10/1972 | Titchenal et al. | 53/384 X |
| 3,780,781 | 9/1974 | Uramoto | 229/66 X |
| 3,791,573 | 11/1974 | Titchenal et al. | 229/69 |
| 4,169,345 | 10/1979 | Douwenga | 53/384 X |
| 4,201,031 | 5/1980 | Wiles | 53/459 X |
| 4,637,060 | 8/1985 | Ausnit | 493/198 X |
| 4,654,878 | 3/1987 | Lems | 53/459 X |
| 4,798,041 | 1/1989 | Bentsen | 53/459 X |
| 4,850,178 | 7/1989 | Ausnit | 53/384 X |

*Primary Examiner*—James F. Coan

*Attorney, Agent, or Firm*—Watts, Hoffmann, Fisher & Heinke Co.

[57] ABSTRACT

A machine and method for loading bags of a preformed web of side interconnected bags. The top of a bag web is slit open and then fed between a pair of belt conveyors. The tops of the bags projecting over the conveyors belts are folded down over them and then gripped by a second pair of conveyor belts. At a load station the belts are spread to open bags sequentially and one at a time for loading. After loading a bag is separated from the web and fed through a sealing section.

30 Claims, 9 Drawing Sheets

PACKAGING MACHINE & METHOD

This invention relates to packaging machinery and more particularly to machine and method which are especially well suited for loading relatively bulky and liquid products sequentially and one at a time into bags of a side interconnected chain of bags.

The use of preopened bags, typically sold in roll form, for packaging products is now well known. Such bags are disclosed and claimed in now expired U.S. Pat. No. 3,254,828 entitled *Flexible Container Strips* issued June 7, 1966 to Hershey Lerner. The product disclosed in that patent has been sold commercially by Automated Packaging System, Inc. of Twinsburg, Ohio under the trademark Autobag for many years.

With a properly made Autobag product, the face of each bag is open from side bead seal to side bead seal while the back of the bag is connected seal to seal to the next succeeding bag in the chain. The connection is by a line of weakness in the form of perforations which permits facile separation of a loaded bag.

Where a bulky product is inserted in such a bag the face of the bag tends to distort and sag while the back of the bag being connected seal to seal does not. In order to produce an attractive and quality finished product, a number of steps have been taken to bring the face of the bag into registration in the back. Steps which have been used commercially include a bag deflator mechanism as disclosed in U.S. Pat. 3,861,113 issued Jan. 21, 1975 to H. Hampton Loughry entitled *Packaging Apparatus and Method* and a bag support as disclosed in U.S. Pat. No. 3,956,866 issued May 18, 1976 to Vincent Lattur.

While the Autobag product has enjoyed great commercial success, there are applications where the product is not fully satisfactory. For example where it is desirable to provide a recloseable bag Autobag products are not readily producible because the reclosure is typically transverse of the bag. Since Autobag products travel in a longitudinal direction during manufacture transverse reopenable capabilities are difficult to provide.

An example of an application where a recloseable feature is desired is the packaging of panty hose which typically must be "stuffed" into a bag. Another reason Autobag products are not fully satisfactory for panty hose is if one stuffs a bulky product into a bag of the Autobag type using, for example, a machine which is sold commercially under the designation H-100 such as the machine shown in U.S. Pat. 3,965,653 issued June 29, 1976 to Bernard Lerner, the force of stuffing the product into the bag tends to separate the back of the bag from the succeeding bag along the line of weakness. Further, the opening through which the product has been stuffed is forced into a generally circular configuration which makes appropriate closing and sealing quite difficult.

The use of preformed bags interconnected in side by side relation have been proposed for loading relatively bulky products. According to this proposal each bag of the chain has a side to side through opening at its top for guiding the chain of bags along a mandrel to a conveyor section. A knife is positioned intermediate the conveyor section and the mandrel for opening the bags. Bags once opened are conveyed to a load station where sequentially and one at a time they are brought to rest in the load station. The open top is spread and a product is inserted. Once the product has been inserted the machine cycles to bring the next bag of the chain to the load station and the loaded bag is transported to a seal station.

The prior proposal had several drawbacks which included the intermittent motion required sealing and loading to occur concurrently. Accordingly the machine could cycle no faster than the time required to load a package or the time required to affect a seal, which ever was the slower. The mechanism for transporting the bags, also served to be the mechanism which resisted applied bag loading forces and accordingly was a limiting factor on the amount of force that could be applied in loading a bag rather than the strength of the bag so limiting the force.

The proposed machine had a load station with a single size opening which limited the machine's use to bags of but a single size. Further no adequate provision was made for separating bags from the web reliably and consistently both in the form of partial separation prior to bag loading and complete separation after a bag was loaded.

SUMMARY OF THE DISCLOSURE

The machine made in accordance with the present invention includes a supply of preformed and side interconnected bags. The bags are fed from the supply into a cyclical section which is preferably an intermittent section of the machine where the bags are opened and sequentially and one at a time loaded Thereafter a loaded bag is separated from the chain and passed through a continuous section where it is sealed.

The intermittent section includes two pairs of intermittent belt conveyors. The first pair of conveyors grasps the chain of bags as it exits a bag slitting station. The bag grasping is at a location below the top of the bags such that upstanding face and back lips of each bag project above the conveyor.

As a bag is conveyed along its path of travel a pair of plows fold these lips respectively over the belts of the first pair of conveyors. The belts of the second pair of conveyors engage the folded over lips to lock the lips between the two conveyors and provide greatly enhanced, as compared with the prior art, bag retention gripping. This gripping not only facilitates the packaging of heavy and bulky products but also allows great latitude in the selection of bag materials. This greater selection is available because the parameters for such physical properties as stiffness and slipperiness are much wider than with prior bagging systems.

The opened bags are fed with their lips between the belt conveyors to a load station sequentially and one at a time. Two pairs of articulated fingers are provided with one pair upstream and one downstream from the center of the load station. These fingers spread the belts of the conveyor and the supported bag into a six sided configuration to permit bag loading. At this juncture the intermittent travel has stopped so that the bag can be spread and loaded.

Once the bag is loaded the fingers allow bag closing and the first of the pair of intermittent conveyors transports the bag to a conveyor of the continuous section.

Operation of the conveyor of the continuous section separates the loaded bag from the chain when the intermittent travel is next stopped. As this happens the lips are pulled over the belts of the first intermittent conveyor which function to bring the lips back to upright positions. The continuous belt conveyor transports the loaded bag through the continuous section including passing through a sealing station in the continuous section and thence to a discharge.

At the input end of the belt conveyor of the continuous section there are a pair of moveable pulleys. Each pulley is mounted on an associated pulley moving mechanism that is controlled by a controller that also controls the intermittent section. When the intermittent section stops and a bag has been positioned at the load station the moveable pulleys are moved away from the path of travel. This movement releases the bag to be loaded from the continuous section and allows a retraction action to move the leading edge of the bag to be loaded as it is spread.

After a bag has been loaded and as it is closed the moveable pulleys are brought in to grasp the now loaded bag and move it into the continuous section for sealing and discharge. As the intermittent section completes its indexing and the next bag to be loaded is moved into the load station and stops, the continued motion of the continuous section separates the loaded bag from the chain. Concurrently with stopping of the intermittent section the moveable pulleys are moved outwardly to release the grip on the next to be loaded and allow it to be retracted.

Another feature of the machine of this invention is that a pair of seal platens are provided. The seal platens are moveable toward and away from the path of bag travel. On start up of the intermittent section following the loading of a bag, the start up signal also signals the platens to move to their closed and bag sealing position. The platens are retained in the bag sealing position for a predetermined timed interval and then in response to a timer signal moved out away from the path of travel. They remain out until the intermittent section controller again signals a loaded bag is about to be transported into the continuous section whereupon the platens are moved into their seal position.

Heat resistent belts are provided to engage a bag as it is transported through the sealer. One advantage of moving the seal platens away from the paths of travel other than when a sealing operation is to be performed is a significant increase in the life of these heat resistent belts.

An important feature of the machine of this invention is that it permits the use of a wide range of bag types. For example gusseted, reinforced header and multi layer bags may all be used with great facility.

Another feature of the invention is that one pair of the bag distension fingers is fixed relative the bag path of travel while the other pair is adjustable relative to the path and the first pair. This allows the machine to be set up for any of a substantial range of bag widths for spreading and loading such bags.

Another feature of the machine of this invention is provision of a knife holder which is both reciprocally and pivotally mounted. The knife holder has a finger which engages a coacting member to hold the knife in bag cutting position. When it is desired to sharpen or replace the knife holder is disengaged from the element, slid upstream relative to the path of travel and then pivoted downwardly to give access to the knife in its connection to the knife holder.

Another feature is a mechanism is provided to rupture lower bag interconnections. More specifically an articulated arm is provided which, when aligned with the interconnection of adjacent bags with the alignment in a plane transverse of the path of bag travel, is swung downwardly and briskly in that plane to rupture the interconnection.

The preferred chain of bags used with machine and method of this invention, provides yet another feature of the invention. The bags are interconnected in side by side relationship by upper and lower sets of frangible interconnections. The preferred bag is a header bag preformed with a header and a pressure sensitively closed flap at the top of the fillable space below the header.

Near the bottom of the bag side to side tunnels are provided for feeding the bags in an inverted condition. The bags are slit open to provide front and back flaps. These flaps are folded away from one another over belts and trapped between the belts over which they are folded and a further or outer set of belts for feeding to and maintenance in a load station.

Accordingly, the object of this invention is to provide a novel and improved packaging machine and a method of packaging products.

Figure 8:
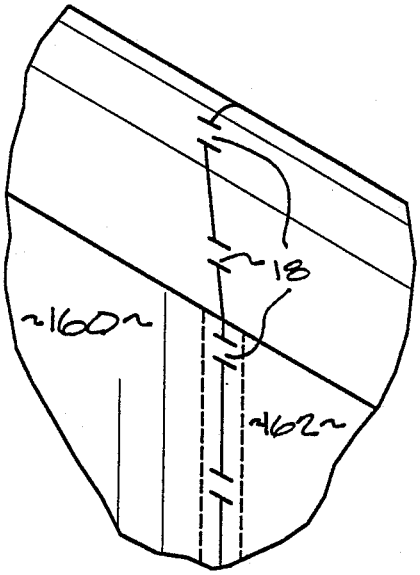
Figure 9:
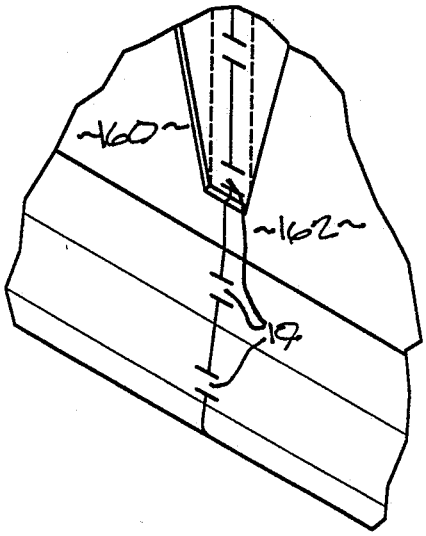

FIGS. *7a–7d* are somewhat schematic perspective views showing a chain of bags in the sequential packaging steps performed by the method of this invention;

FIG. 8 is an enlarged fragmentary view showing a top set of interconnections between two adjacent bags; and FIG. 9 is an enlarged fragmentary view showing a lower set of interconnections between sequential bags.

DETAILED DESCRIPTION

Figure 1:
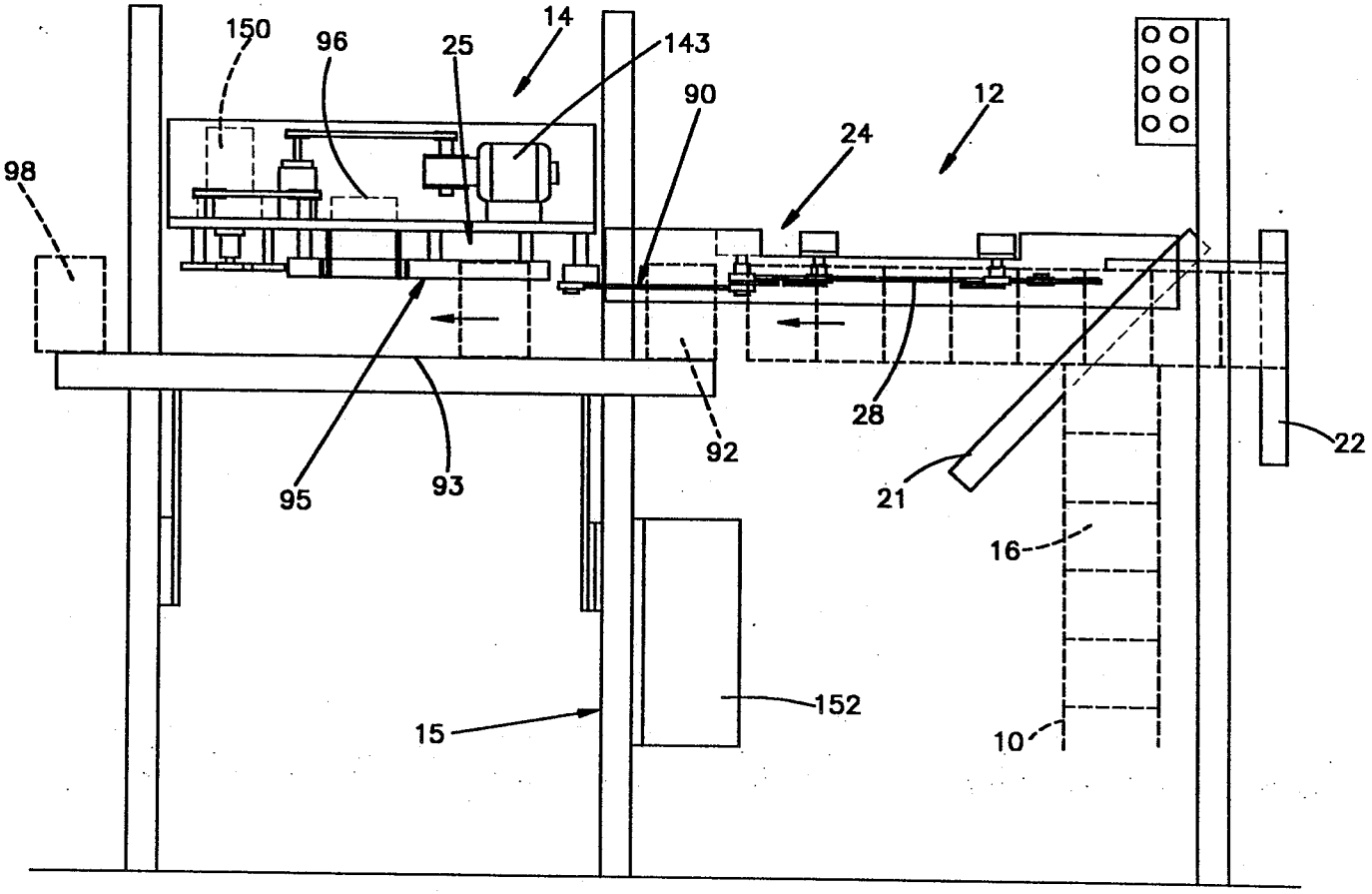
FIG. 1 is a somewhat schematic elevational view of the packaging machine of this invention.

Referring to the drawings and to FIG. 1 in particular a bag supply is shown generally at 10. The machine has intermittent and continuous sections 12, 14 supported on a frame 15. The frame 15 also supports the bag supply 10.

A chain of interconnected bags 16 is fed from the supply 10. The bags are interconnected in side by side relationship by upper and lower frangible interconnections 18, 19. The chain of bags 16 is fed from the supply 10 upwardly over a 45 degree guide 21 thence horizontally to and around a vertical guide 22.

The chain of bags is fed horizontally from the vertical guide 22 into and through the intermittent section 12. The intermittent section 12 includes a loading station shown generally at 24 where products are inserted into the bags sequentially one bag at a time. Loaded bags are transported from the intermittent section 12 into the continuous section 14. The continuous section 14 includes a sealer station shown generally at 25 where loaded bags are sealed. Thereafter the loaded and sealed bags are discharged from the machine.

The Intermittent Section 12

The intermittent section includes an inner pair of belt conveyors including first and second intermittent conveyor belts 27, 28. The belts 27, 28 are reeved around sets of pulleys including a pair of entrance end pulleys 29. The inner conveyor belts 27, 28 include bag path of travel defining reaches 30, 31 extending from the entrance pulleys 29 to an exit from loading station 24.

An outer pair of conveyors are provided including first and second belts 33, 34. The outer conveyor belts 33, 34 have reaches 35, 36 which are juxtaposed against the inner conveyor reaches 30, 31 from outer conveyor entrance pulleys 38 to the exit from the load station 24.

Figure 6:
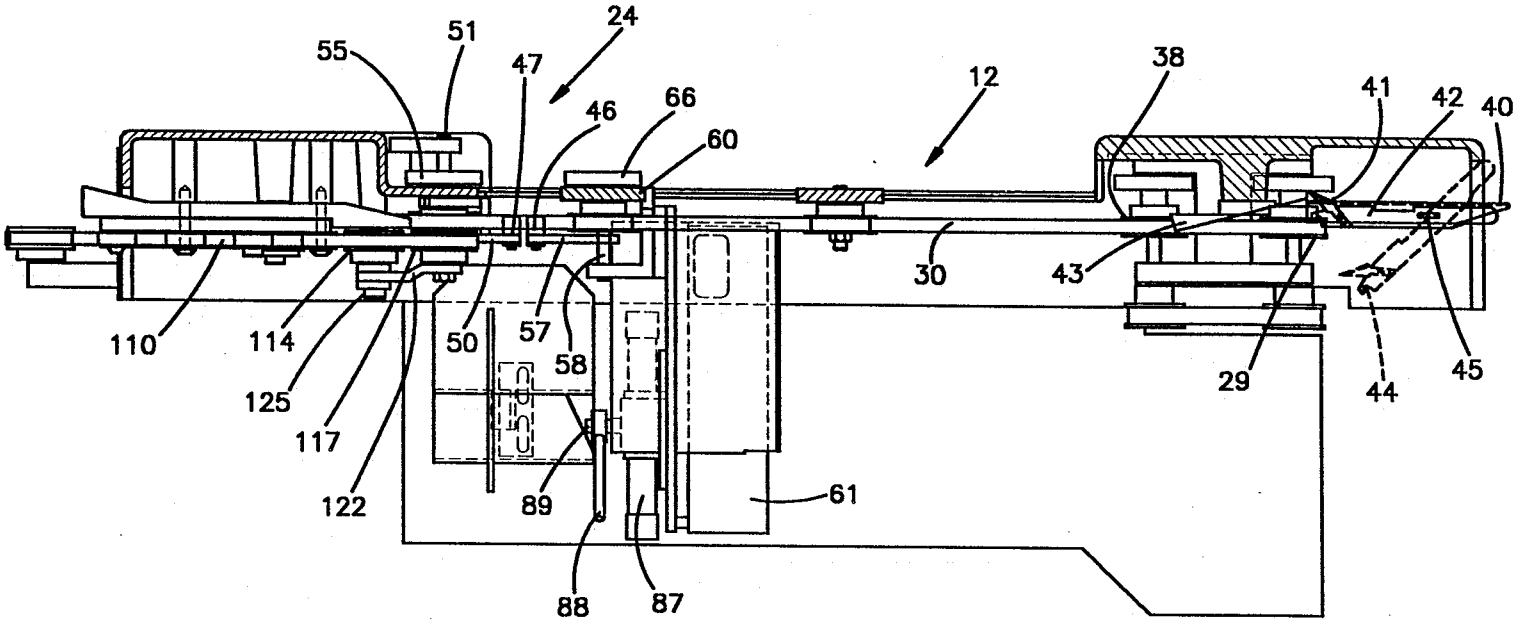
FIG. 6 is a sectional view of the intermittent section of the machine as seen from the plane indicated by the line 6—6 of FIG. 2.
Figure 7A:
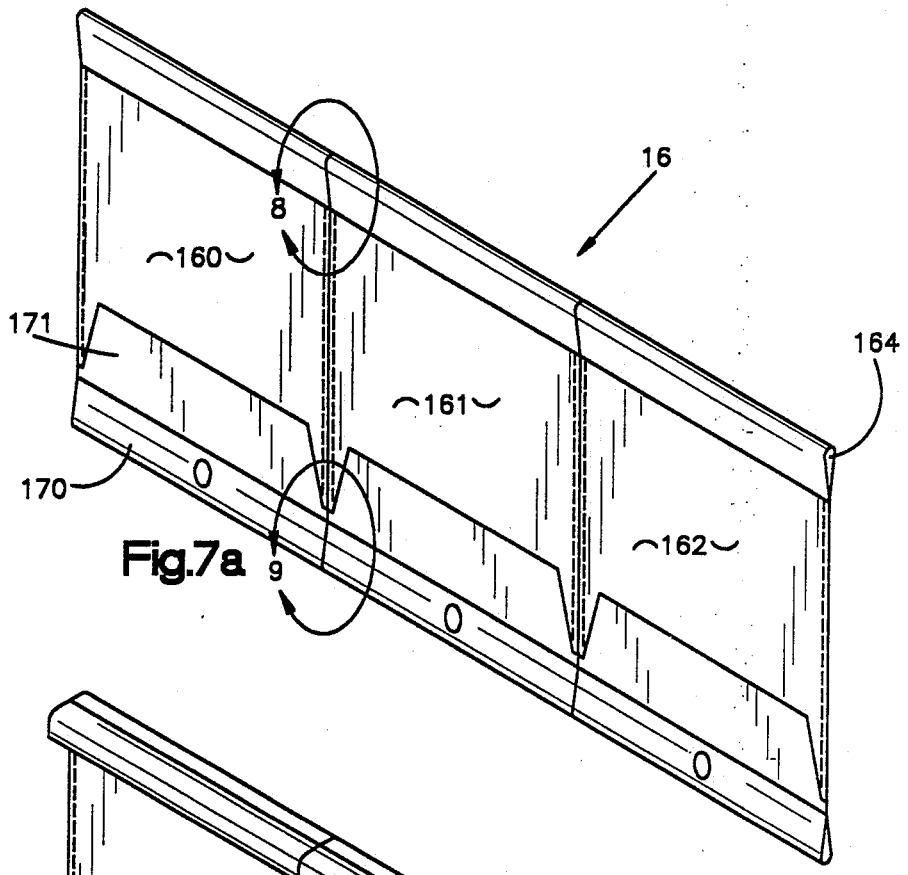
Figure 7B:
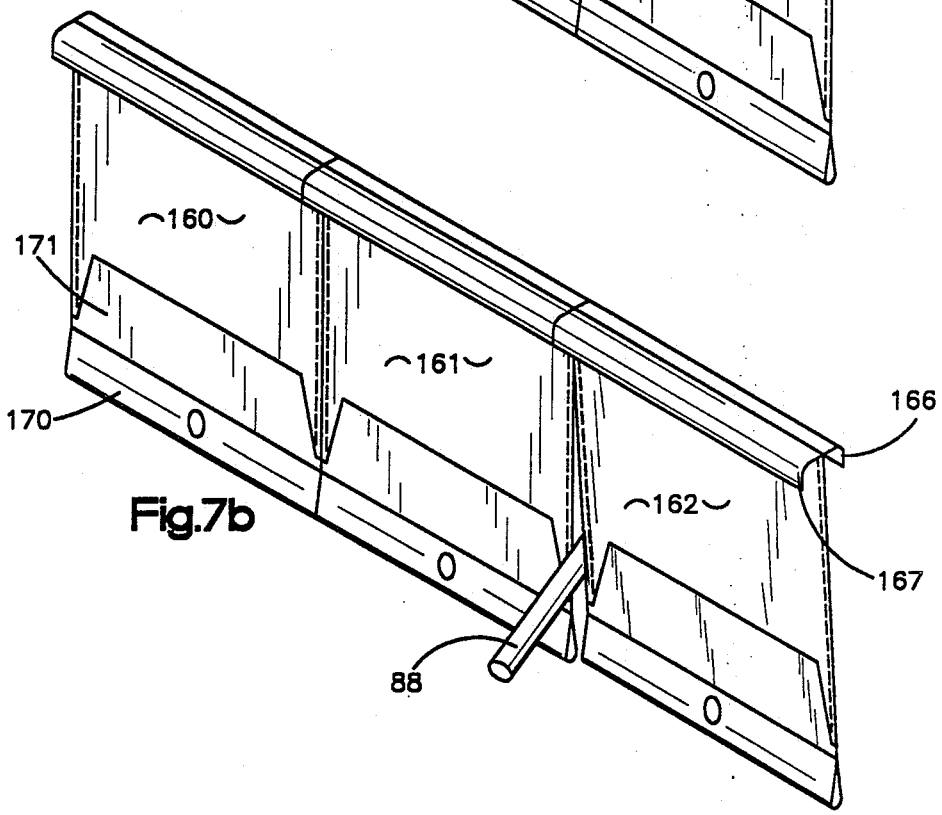
Figure 7C:
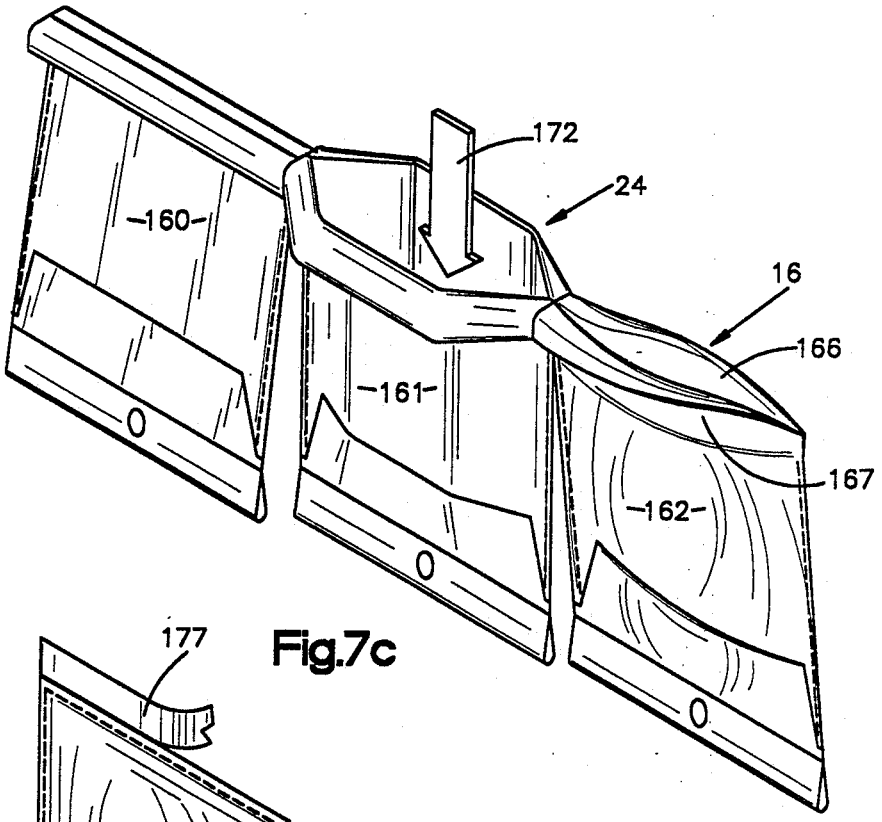
Figure 7D:
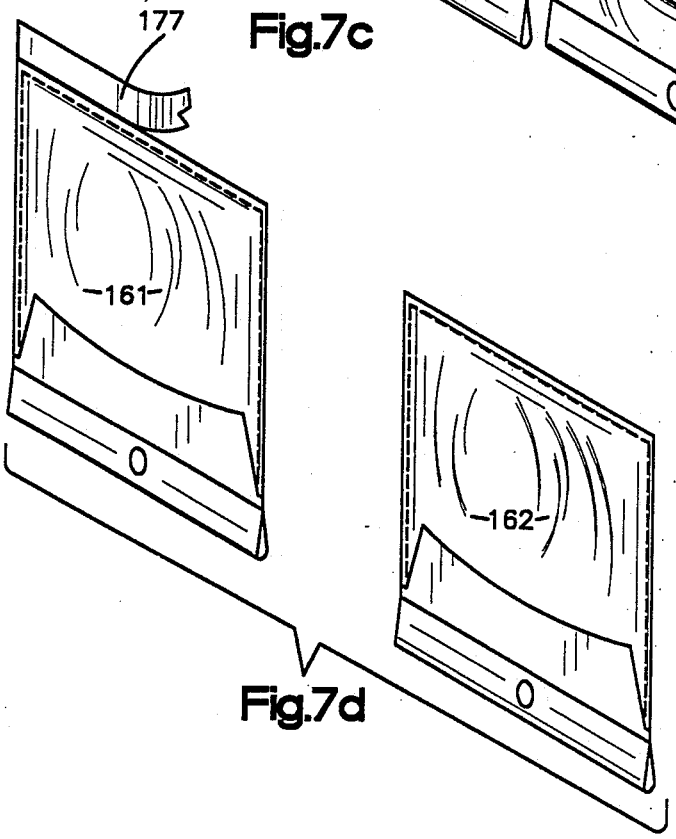

Referring to FIG. 6, each bag fed from the vertical guide 22 has a through opening at the top extending from one side to the other. A mandrel 40 is fed through those openings as the bags are guided to the path of travel delineated by the reaches 30, 31.

A knife 41 is positioned closely adjacent to, but upstream of, the reach defined portion of the bag path of travel. The knife is carried by a knife holder 42. The knife 41 slits the bags along their tops to provide bag face and the back upstanding lips which project above the conveyor reaches 30, 31. These lips are folded away from one another over the reaches 30, 31 respectively by the action of a plow 43 positioned between the knife 41 and the outer conveyor entrance pulleys 38.

As bags are fed from the plow along the reach defined portion of the bag path of travel, the outer reaches 35, 36 engage the folded over lips to trap the lips respectively between inner and outer reaches 30, 35 on the one hand and inner and outer reaches 31, 36 on the other.

The knife holder 42 is moveable from the solid line position of FIG. 6 to the phantom position to facilitate sharpening or replacement of the knife 41. To accomplish blade sharpening or replacement the holder is rotated slightly in a clockwise direction as seen in FIG. 6 to disengage a holder notch 44 from an upstanding lip on the frame. The knife holder includes an elongated slot 45 which receives a supporting pin. Once the notch is disengaged the slot allows the holder to be shifted to the right as seen in FIG. 6 and then pivoted to its phantom line position.

Upstream and downstream pairs of fingers 46, 47 are provided at the load station. The fingers are interposed between the reaches 30, 31 of the inner conveyor for selectively distending the reaches and a bag carried by them when positioned at the load station. The fingers distend a bag and the reaches from the position shown in phantom at 48 to the solid line position of FIG. 2.

Referring to FIG. 6, a link 50 couples the finger 47 to a rotatable but otherwise fixed shaft 51. Rotation of the shaft 51 will cause the arm 50 to move the finger 47 and distend the reach 30, when rotation is counter clockwise, as viewed in FIG. 2, to the solid line position of FIG. 2. A mirror image linkage, not shown in elevation, carries the other downstream finger 47 for movement in an equal and opposite direction.

Figure 2:
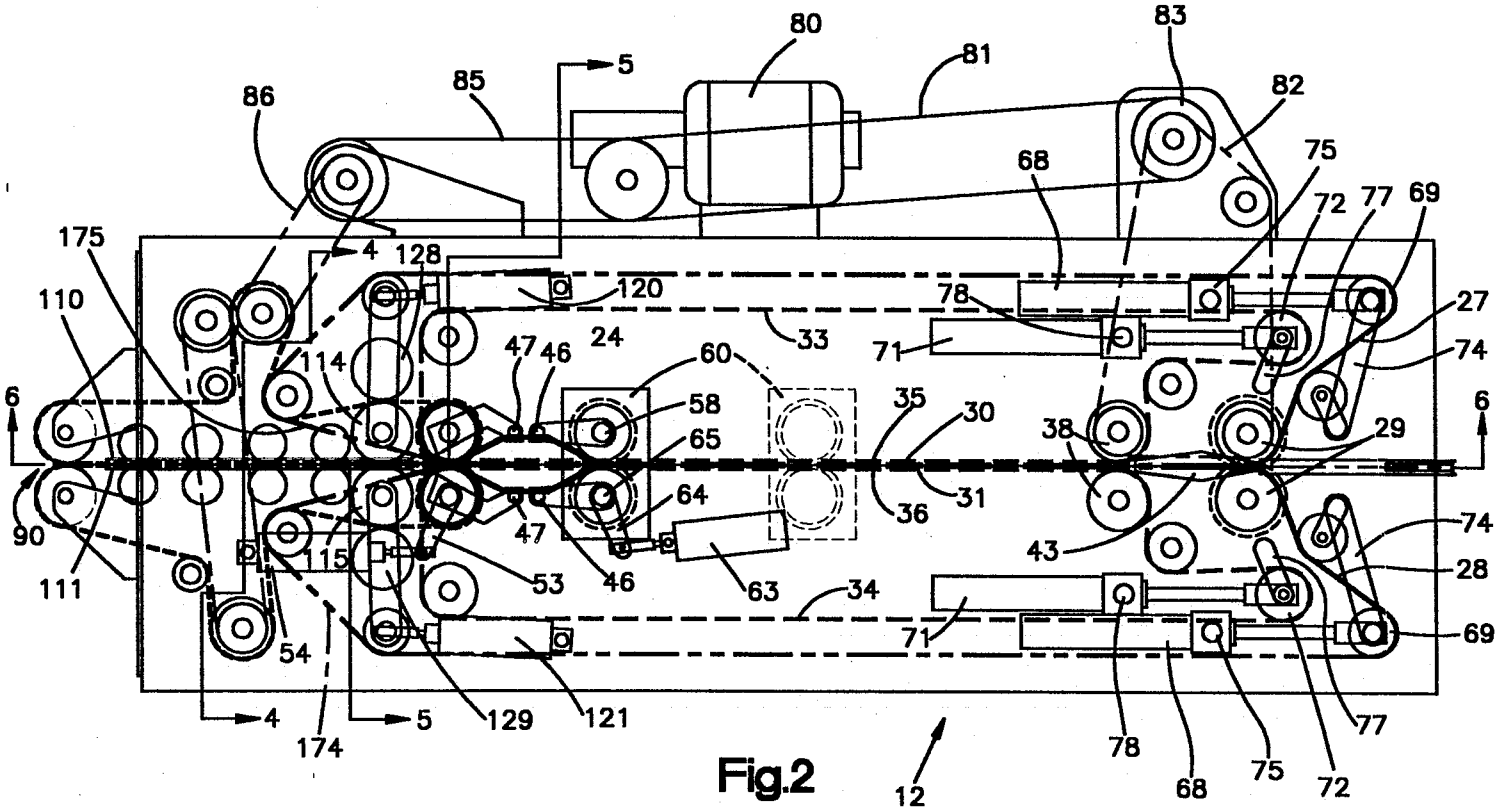
FIG. 2 is a top plan view on an enlarged scale with respect to FIG. 1 of an intermittent section of the machine.

A drive link 53 is coupled to an air cylinder 54, FIG. 2. Actuation of the air cylinder causes the fingers 47 to be concurrently and oppositely moved from opened to closed positions and return. The concurrent opposite movement is controlled through a pair of interconnected gears one of which is shown at 55 in FIG. 6.

As is best seen in FIG. 6, the upstream finger 46 is connected by a link 57 to a shaft 58. The shaft 58 is journal in a movable frame element 60. The frame element 60 is movable longitudinally of the bag path of travel to adjust the spacing of the upstream and downstream fingers 46, 47 according to the size of bag to be loaded.

The frame 60 carries an indicia detector 61 which is preferably of the type disclosed and claimed in the U.S. Pat. 4,392,056 entitled Control Marking Detector issued to Ronald Weyandt. The bags are equipped with invisible indicia such as those described in U.S. Pat. 4,680,205 entitled Continuous Web Registration issued to Hershey Lerner et al to which the detector 61 is able to respond. Signals from the detector 61 control the cycling of the intermittent section 12.

The movable frame section 60 carries an air cylinder 63 FIG. 2. The cylinder 63 is connected through a linkage in FIG. 2 to a shaft 65 which is the mirror image of the shaft 58 of FIG. 6. The shafts 58, 65 are connected by gears 66 to cause equal and opposite action so that the interconnected upstream fingers 46 are concurrently moved from bag closed to bag opened positions and return.

As the fingers 46, 47 are actuated to open a bag and to spread the belt reaches, the effect is to foreshorten the four belts of the inner and outer conveyors. To accommodate this foreshortening of the inner conveyor a pair of cylinders 68 are provided which carry movable pulleys 69. The movable pulleys 69 move in synchronism with movement of the fingers 46, 47 to allow the reaches to be spread while at the same time maintaining the belts 27, 28 appropriately tensioned. Similarly, cylinders 71 are coupled to movable pulleys 72 to accommodate foreshortening and stretching of the outerbelts 33, 34. The cylinders 68, 71 are spring extended air cylinders so that contact of the pulleys 69, 72 is through air pressure control when the machine is operated while belt tension is maintained by the springs when the machine is down.

The pulleys 69 are mounted on pivotal links 74. As a consequence movement of the pulleys 69 is an arcuate movement. To accommodate this arcuate movement the cylinders 68 are pivotally mounted at 75. Similarly, the innerbelt pulleys 72 are mounted on links 77 and the cylinders 71 are pivotally mounted at 78.

A drive motor 80 is provided The drive motor 80 is coupled to the intermittent section through belts 81, 82. A clutch is interposed at 83 between the belts 81, 82 to provide intermittent drive of the intermittent section. Belts 85, 86 couple the drive motor 80 to the continuous section 14.

Once a bag is positioned at the load station lower interconnections 19 between the positioned bag and the next bag of the chain are ruptured. To accomplish this rupturing, an articulated arm 88 known as a "whacker" is provided, FIG. 6. The arm 88 is mounted on a shaft 89 for movement from an upper position (now shown) to a rupture completed position as shown in FIG. 6 and return each time it is cycled. The whacker is driven by a pneumatic rotary actuator 87.

The Continuous Section 14

An entrance pair of continuous belt conveyors are indicated generally at 90, FIG. 1. These conveyors grasp a loaded bag 92 at a time when the intermittent section is at rest. The grasping of the loaded bag 92 by the conveyors 90 results in rupturing of the upper frangible inter-connection 18 separating the loaded bag for movement into the continuous section. As the loaded bag 92 is moved through the continuous section 14 it is supported by a product support conveyor 93.

The loaded bag is transferred from the entrance continuous conveyors 90 to a pair of sealer continuous conveyors 95 and moved through the sealing station 25. The sealing conveyors transport the loaded bag from the sealing station through a cooling station 96 to a discharge indicated by the bag shown in dotted lines at 98.

Figure 4:
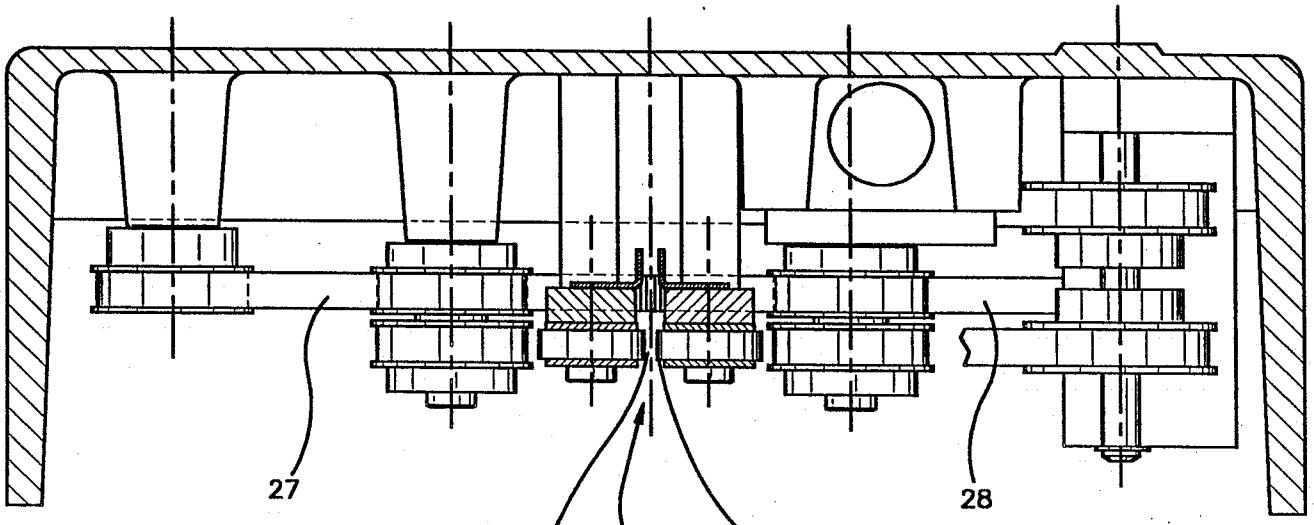
FIG. 4 is a sectional view of the intermittent section as seen from the planes indicated by the line 4—4 of FIG. 2.

Belts of the entrance conveyors 90 include reaches 110, 111 which define a continuation of the bag path of travel. The reaches 110, 111 are seen in plan view to the left in FIG. 2 in, sectional view in FIG. 4 and the reach 110 is seen in elevation in FIG. 6. The reaches 110, 111 are reeved over fixed location pulleys 114, 115. As is best seen in FIGS. 5 and 6, these fixed location pulleys and the belts of the entrance conveyor are located immediately below the belts of the intermittent conveyors.

A pair of nip pulleys are provided which engage the reaches 110, 111. One of the nip pulleys is visible at 117 in FIGS. 5 and 6 while the other not shown is the mirror image of it. The nip pulley 117 is shown in FIGS. 5 and 6 axially aligned with the shaft 51. This is the nip position of the pulley. The nip pulleys are selectively movable between the nip position and a retracted position in concurrent and opposite motions selectively to engage or release a bag disposed in the loading station 24.

Figure 5:
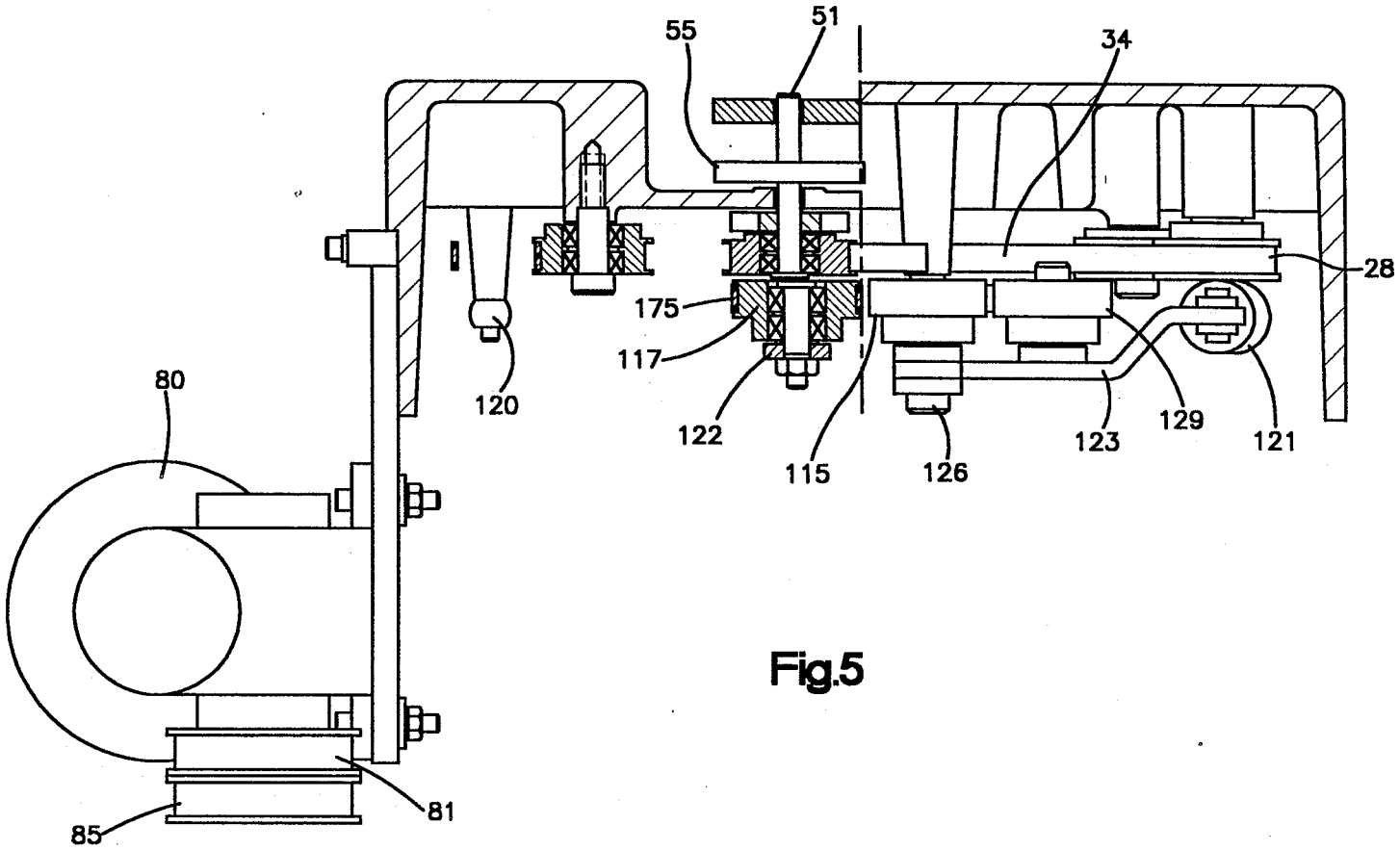
FIG. 5 is a sectional view of the machine as seen from the planes indicated by the line 5—5 of FIG. 2.

A pair of nip pulley cylinders 120, 121 are provided FIGS. 2 and 5. A pair of links 122, 123 are respectively connected to and driven by the cylinders 120, 121. The links 122, 123 are respectively journaled on fixed location pulley shafts 125 FIG. 6 and 126 FIG. 5. Mirror image movable idler pulleys 128, 129 are respectively carried by the links 122 and 123. The idler pulleys 128, 129 are shown in FIG. 2 in both their nip positions while the pulley 129 is shown in elevation in FIG. 5.

The nip pulley cylinders 120, 121 are actuated in synchronism with movements of the intermittent section. More specifically when the clutch 83 is energized to stop intermittent section movement, the cylinders 120, 121 are energized to move the nip pulleys 117, 118 to their retracted positions releasing the grip on the bag which is about to be loaded. Momentarily later the finger manipulating cylinders 54, 63 are energized to cause the fingers 46, 47 to spread a bag about to be loaded.

The sealing conveyors 95 are above and slightly overlapping the entrance conveyors 90 and operate in synchronism with them. Thus, as a loaded bag is transported from the entrance conveyors it is grasped by belts 131, 132 of the sealing conveyors. The belts are of a material such as Teflon® which is suitable for transmitting heat from a heater bar to a bag being sealed without becoming adhered to the bag.

A pair of heat seal platens 134, 135 are provided. Air cylinders 136, 137 are connected to the platens 134, 135 respectively. The cylinders move the platens into juxtaposed relationships with the belts 131, 132 when the bag is to be sealed and in timed relationship move the platens 134, 135 outwardly to the position shown in phantom in FIG. 3 after a bag has been sealed.

The sealing conveyors 95 transport the bags through the cooling station 96 and thence to an exit conveyor shown generally at 140. Belts 141, 142 couple the sealing and discharge conveyors together and to a sealing section drive motor 143.

Figure 3:
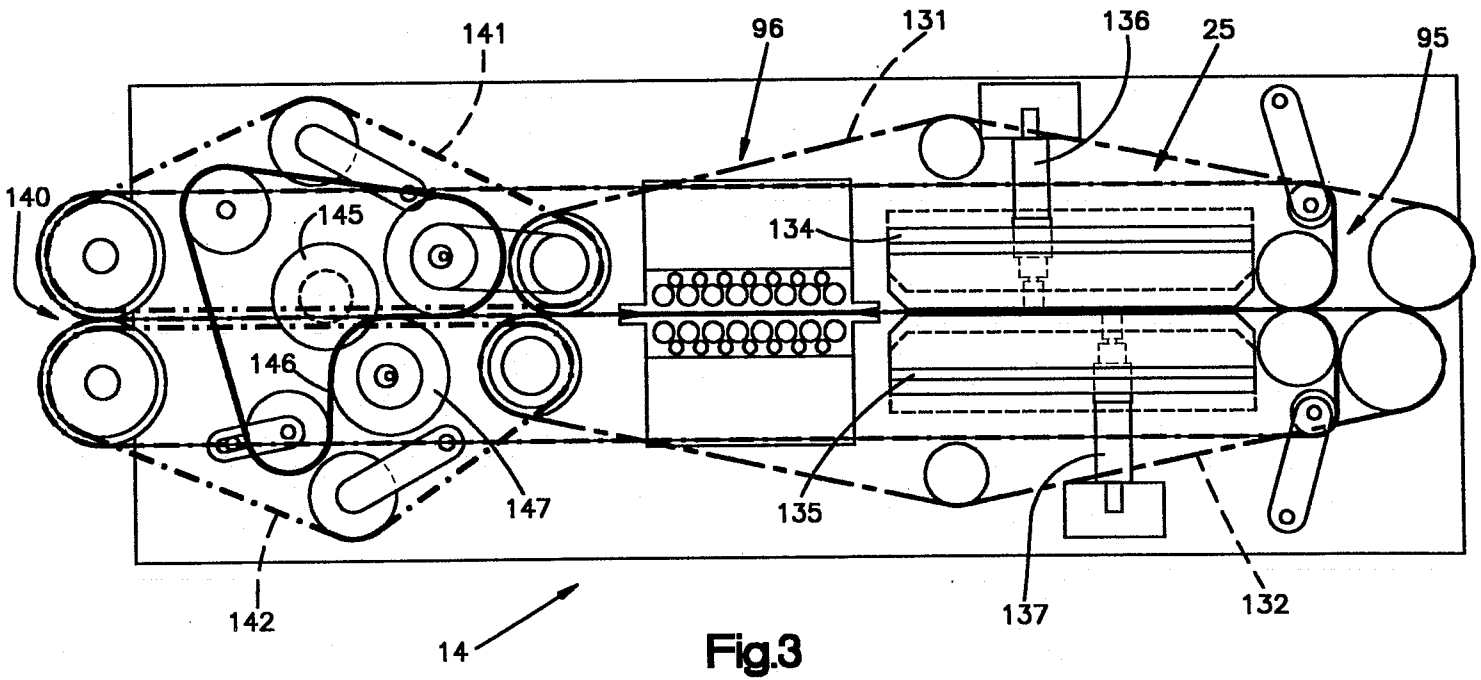
FIG. 3 is a top plan view of a continuous section of the machine.

A trim knife in the form of a wheel 145 is provided. A scrap belt 146 is reeved around an anvil wheel 147 to trap trim scrap and cause it to exit in a downward direction as seen in FIG. 3. The knife and scrap conveyor are driven by a motor 150 shown in FIG. 1.

The Chain Of Bags 16

Referring to FIG. 7–9, the chain of bags comprises bags 160, 161, 162. The bags are connected together in side by side relation by the upper and lower sets of interconnections 18, 19, FIGS. 8 and 9.

The bags as shown in FIGS. *7a–d* are in an inverted position. The bags have a through tunnel 164 best seen in FIG. *7a*. This tunnel 164 is fed over the guide mandrel 40 as the bags are fed into the intermittent section 12. As the bags pass the knife and then the plow the bags are slit longitudinally at the top of the tunnel 164 to form front and back flaps 166, 167 which are then folded over by the plow 43 to the position shown in FIG. *7b*.

The preferred and disclosed bags each include a header 170 at the top of the bag delineated by upper and lower seals not shown. Each bag has a fillable space provided immediately below the header 170 but shown immediately above in the inverted views of FIGS. 7. The fillable space is closed by a reusable flap 171 that is adhered to the back of the bag by a suitable pressure sensitive adhesive, not shown.

As the bag is advanced along its path of travel as depicted in FIG. *7b*, it reaches a position where the whacker 88 is brought abruptly and sharply downwardly to sever the lower set of interconnections 19. The bags are then fed to the load station 24 where they are spread in the manner which has been described. A product is inserted by moving it along the path indicated by arrow 172.

As the bag 162, depicted in FIG. *7c* in its now loaded condition, is moved into the continuous section by the operation of the entrance conveyor 90, the front and back flaps 166, 167 are drawn over divergent reaches 174, 175 of the innerconveyor belts 28, 27, FIG. 2. Drawing the flaps over the reaches 174, 175 cams them back upwardly to upstanding generally face to face conditions for passing through the continuous section of the conveyor.

In FIG. *7d* the bags 160, 162 are pictured in their completed condition. In the case of the bag 161 a scrap strip being severed by the scrap knife 145 is depicted at 177.

Operation

The supply of bags 10 is positioned to feed the bag chain 16 to the machine. The bags are fed over the 45 degree guide 21 and around the vertical guide 22. The guide mandrel 40 is then fed into the transverse tunnel 164 of the lead one of the bags. The bags are then fed from left to right as seen in FIGS. 1 and 2, past the knife 41 to slit the bag tops and form the front and back flaps 166, 167.

The bags are picked up by the belts 27, 28 of the outer conveyors and fed past the plow 43 to fold the front and back flaps respectively over the belts 27, 28. The folded flaps are then captured between the belts 33, 34 of the outer conveyors so that the folded flaps are respectively trapped between the reaches 30, 35 on the one hand and 31, 36 on the other for feeding to the load station 24. The lower frangible connection set 19 between the lead one of the bags and the second bag in the chain is fractured by the whacker 88.

Once the machine has been set up in the manner described, which set up is accomplished by jogging the machine, the machine is turned on and prepared to cycle automatically. The motor 80 operates continuously operating the entrance conveyor 90 to the continuous section on a continuous basis. Similarly the motor 143 operates continuously to operate the continuous section 14 on a continuous basis.

The clutch 83 is energized to cause the intermittent section to feed until the indicia detector 61 recognizes an indicia on a succeeding bag. The detector sends a signal to a control 152 seen in FIG. 1. A control signal from the control 152 de-energizes the clutch 83 to stop the intermittent section. Concurrently the nip pulley cylinders 120, 121 are energized to move the nip pulleys 117, 118 away from the bag path of travel. Momentarily after that the finger cylinders 54, 63 are energized to respectively move the pairs of fingers 47, 46 away from one another to spread the bag at the load station into an open condition.

The product is then inserted. The insertion mechanism transmits a signal to the control 152. The control 152 then simultaneously signals the cylinders 120, 121 to reverse their action and move the nip rolls into bag engaging position and energizes the clutch 83 to start intermittent bag operation. The finger cylinders 54, 63 are then actuated to move the fingers to closed positions. The entrance conveyor to the continuous section grasps the loaded bag and moves it toward the seal station. As the loaded bag is pulled from the loading station the inner conveyor belts 27, 28 cam the front and back bag lips 166, 167 back to upright positions.

When the next bag reaches the detector 61 and the clutch 83 is de-energized to stop the intermittent section, the now loaded bag is fully in the grasp of the entrance conveyor which continues the movement of the loaded bag while the to be loaded bags in the intermittent section are stopped. This action ruptures the upper set of frangible connections 18 between the loaded bag and the next bag.

The loaded bag is transported by the entrance conveyor 90 to the sealing conveyor 95. The platens 134, 135 have been moved by the platen cylinders 136, 137 to their closed position in response to the same signal that restarted the intermittent section. The loaded bag is moved between the platens thence through the cooling station 96 to the discharge conveyor 140. As the loaded and now sealed bag is moved by the discharge conveyor the scrap knife 145 trims the top of the bag, the scrap is removed by the scrap belt 146 and the loaded bag is thence transported to the discharge 98.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a packaging machine for sequentially loading and then sealing bags of a series interconnected in side by side relationship, the improvement comprising:

a) machine and frame structure establishing a bag path of travel;

b) a bag loading mechanism positioned at a bag loading station along the path;

c) a bag closing mechanism at a closing station along the path;

d) conveyor means for transporting such interconnected bags of a series sequentially to the load and then to the closing station;

e) the conveyor means including a cyclical motion section for bringing such bags to the load station and then momentarily arresting bag motion to enable filling;

f) the conveyor means including a continuous motion section along the path of travel downstream from the load station for separating a loaded bag from the interconnected series and transporting such separated bag in continuous motion through the closing station; and, the bag loading mechanism including two spaced pairs of fingers and adjustment means for selectively positioning the pairs in predetermined spaced relationship determined according to the size of bag to be packaged.

2. A machine for packaging products using chains of interconnected bags comprising:

a) a bag supply conveyor assembly for transporting such interconnected bags from a supply to a load station and sequentially delivering bags one at a time and in an open condition to the load station;

b) bag opening means at the load station including two spaced pairs of fingers for distending the opening of a bag positioned in the load station into a six sided configuration, the opening means including structure for fixing the two pairs in a selected spaced relationship appropriate for the size of bag to be delivered to the load station;

c) an output conveyor for sequentially transporting loaded bags from the load station through a bag closure and thence to a discharge; and, d) the output conveyor being continuously operating when the machine is in use.

3. In a packaging machine for sequentially loading and then sealing bags of a series interconnected in side by side relationship, the improvement comprising:

a) machine and frame structure establishing a bag path of travel;

b) a bag loading mechanism positioned at a bag loading station along the path;

c) a bag closing mechanism at a closing station along the path;

d) conveyor means for transporting such interconnected bags of a series sequentially to the load and then to the closing station;

e) the conveyor means including a cyclical motion section for bringing such bags to the load station and then momentarily arresting bag motion to enable filling;

f) the conveyor means including a continuous motion section along the path of travel downstream from the load station for separating a loaded bag from the interconnected series and transporting such separated bag in continuous motion through the closing station; and, g) the continuous motion section including an input end portion selectively moveable toward and away from a bag path of travel for selectively gripping or releasing a bag projecting into the continuous motion section.

4. The machine of claim 3 wherein there is a bag support beneath the continuous section.

5. A machine for packaging products using chains of interconnected bags comprising:

a) a bag supply conveyor assembly for transporting such interconnected bags from a supply to a load station and sequentially delivering bags one at a time and in an open condition to the load station;

b) bag opening means at the load station including two spaced pairs of fingers for distending the opening of a bag positioned in the load station into a six sided configuration, the opening means including finger position control means for fixing the two pairs in a selected spaced relationship within an adjustment range and appropriate for the size of bag to be delivered to the load station; and c) an output conveyor for sequentially transporting loaded bags from the load station through a bag closure and thence to a discharge.

6. The machine of claim 5 wherein the bag closure comprises a heat sealer including a pair of platens moveable between spaced and juxtaposed positions on opposite sides of the paths of travel.

7. A machine for packaging products using chains of interconnected bags comprising:

a) a bag supply conveyor assembly for transporting such interconnected bags from a supply to a load station and sequentially delivering bags one at a time and in an open condition to the load station;

b) bag opening means at the load station including two spaced pairs of fingers for distending the opening of a bag positioned in the load station into a six sided configuration, the opening means including structure for fixing the two pairs in a selected spaced relationship appropriate for the size of bag to be delivered to the load station;

c) an output conveyor for sequentially transporting loaded bags from the load station through a bag closure and thence to a discharge; and, d) the assembly including two pairs of belt conveyors.

8. In a packaging machine for packaging products in sequentially delivered interconnected bags, the machine including cyclical and continuous sections, the improved continuous section comprising:

a) a pair of belt conveyors delineating a loaded bag path of travel;

b) each conveyor including a roller moveable between bag engagement and bag release positions;

c) a controller; and, d) each conveyor including a roller positioning means connected to the moveable roller of the same conveyor for moving the roller between its positions in response to start and stop signals from the controller.

9. The machine of claim 8 wherein a drive is connected to the conveyor for continuous operation when the conveyors are in use.

10. In a machine for filling bags of an interconnected chain of bags the improvement comprising:

a) a first pair of belt conveyors delineating a path of bag travel therebetween;

b) a plow positioned along the path for folding upstanding face and back lips of each bag, each lip being folded over an adjacent and respective one of the conveyor belts;

c) a second pair of belt conveyors positioned on opposite sides of the path and downstream from the plow;

d) one of the second belts having a reach closely juxtaposed to a reach of one of the first belts for gripping folded face lips therebetween; and, e) the other of the second belts having a reach closely juxtaposed to a reach of the other of the first belts for gripping folded back lips therebetween.

11. The machine of claim 10 wherein said reaches of the first pair extending downstream along the path of travel further than said reaches of the second pair.

12. The machine of claim 10 wherein an articulated bag connection rupturing means is positioned along the path for rupturing interconnections between adjacent bags.

13. The machine of claim 10 wherein an articulated bag opening means is positioned along the path of travel between the ends of the reaches for spreading a bag to be loaded and the reaches to open such bag.

14. The machine of claim 10 wherein a guide is provided for guiding a chain of side connected bags to the path of travel and a bag slitter is interposed between the guide and the path.

15. A machine for packaging products using chains of interconnected bags comprising:

a) a bag supply conveyor assembly for transporting such interconnected bags from a supply to a load station and sequentially delivering bags one at a time and in an open condition to the load station;

b) bag opening means at the load station including two spaced pairs of fingers for distending the opening of a bag positioned in the load station into a six sided configuration, the opening means including structure for fixing the two pairs in a selected spaced relationship appropriate for the size of bag to be delivered to the load station;

c) an output conveyor for sequentially transporting loaded bags from the load station through a bag closure and thence to a discharge; and, d) a drive connected to the conveyor 5 for continuous operation when the conveyors are in use.

16. The machine of claim 15 wherein a sealer defines the closure station and the sealer includes a pair of platens moveable toward and away from one another from a sealing position where each platen is in juxtaposition to a reach of an associated one of the second conveyor pair to a spaced position and return.

17. The machine of claim 15 wherein there is a second pair of continuous belt conveyors downstream of the mentioned conveyors for transporting bags through a closure station.

18. A packaging machine for sequentially loading and then sealing bags of a series interconnected in side by side relationship comprising:

a) machine and frame structure establishing a bag path of travel;

b) an intermittent bag supply conveyor means carried by the frame structure and adapted to transport such interconnected bags from a supply to a load station and sequentially deliver bags one at a time to the load station;

c) bag opening means at the load station including fingers for distending the opening of a bag positioned in the load station, the opening means including structure for fixing the fingers in a selected spaced relationship appropriate for the size of bag to be delivered to the load station;

d) a bag sealing mechanism at a sealing station along the path;

e) continuous conveyor means for transporting such interconnected bags of a series sequentially from the load to the sealing station;

f) the intermittent conveyor means being adapted momentarily to arrest bag motion at the load station to enable filling; and, g) the continuous conveyor means being adapted to separate a loaded bag from the interconnected series and transport such separated bag in continuous motion through the sealing station.

19. The machine of claim 18 wherein the bag opening means is operative to distend a bag opening into a six sided configuration.

20. The machine of claim 18 wherein the bag opening means includes two spaced pairs of fingers and adjustment means for selectively positioning the pairs in predetermined spaced relationship determined according to the size of bag to be packaged.

21. The machine of claim 18 wherein the intermittent conveyor means comprises:

a) a first pair of belt conveyors delineating a path of bag travel therebetween;

b) a plow positioned along the path for folding upstanding face and back lips of each bag, each lip being folded over an adjacent and respective one of the conveyor belts;

c) a second pair of belt conveyors positioned on opposite sides of the path and downstream from the plow;

d) one of the second belts having a reach closely juxtaposed to a reach of one of the first belts for gripping folded face lips therebetween; and, e) the other of the second belts having a reach closely juxtaposed to a reach of the other of the first belts for gripping folded back lips therebetween.

22. The machine of claim 18 wherein a controller is provided and the continuous conveyor means comprises:

a) a pair of belt conveyors delineating a loaded bag path of travel;

b) each conveyor including a roller moveable between bag engagement and bag release positions; and, c) each conveyor including a roller positioning means connected to the moveable roller of the same conveyor for moving the roller between its positions in response to start and stop signals from the controller.

23. The machine of claim 22 wherein the controller is connected to the intermittent conveyor means and the movement of the roller positioning means is coordinated with movement of the intermittent conveyor means.

24. A method of packaging utilizing a chain of bags side to side interconnected by sets of frangible interconnections comprising:

a) cyclically feeding the chain along a path of travel;

b) slitting the bags along an upwardly oriented end;

c) with a first pair of belt conveyors grasping portions of the bags near their slit ends while leaving face and back lips projecting upwardly from the belts;

d) utilizing a plow to fold the lips outwardly in opposite directions from the path of travel respectively over the belts of the first pair;

e) capturing the folded lips between the belts of the first pair of conveyors and belts of a second pair of belt conveyors;

f) rupturing a set of interconnections near a downwardly oriented end of a selected one of the bags from a succeeding bag;

g) positioning the selected one of the bags at a load station;

h) spreading the top of the selected bag and contacting sections of the belts to open the bag;

i) inserting a product in the selected bag;

j) closing the selected bag and feeding it from the load station into a continuation of the path between belts of a continuously operating pair of belt conveyors; and, k) securing the bag lips together.

25. The method of claim 24 wherein the securing step comprises feeding the loaded bag between platens of a heat sealer.

26. The method of claim 25 further comprising the step of moving the sealer platens away from the path of travel after the selected bag has been sealed.

27. In a machine for manipulating a plastic web the improvement comprising:

a) a first pair of belt conveyors delineating a path of web travel therebetween;

b) structure for slitting the web to form two lips;

c) a plow positioned along the path for folding the lips, each lip being folded over an adjacent and respective one of the conveyor belts;

d) a second pair of belt conveyors positioned on opposite sides of the path and downstream from the plow;

e) one of the second belts having a reach closely juxtaposed to a reach of one of the first belts for gripping folded face lips therebetween; and, f) the other of the second belts having a reach closely juxtaposed to a reach of the other of the first belts for gripping folded back lips therebetween.

28. The machine of claim 27 wherein said reaches of the first pair extending downstream along the path of travel further than said reaches of the second pair.

29. The machine of claim 28 wherein there is a second pair of continuous belt conveyors downstream of the mentioned conveyors for transporting bags through a closure station.

30. The machine of claim 28 wherein a sealer defines the closure station and the sealer includes a pair of platens moveable toward and away from one another from a sealing position where each platen is in juxtaposition to a reach of an associated one of the second conveyor pair to a spaced position and return.

* * * * *